United States Patent [19]

Holm

[11] 4,442,851

[45] Apr. 17, 1984

[54] CLEANING OF OBJECTS WITH SOLVENT

[75] Inventor: Kurt A. Holm, Skoghall, Sweden

[73] Assignee: Bycosin AB, Karlstad, Sweden

[21] Appl. No.: 391,225

[22] Filed: Jun. 23, 1982

[30] Foreign Application Priority Data

May 24, 1981 [SE] Sweden ..... 8103968

[51] Int. Cl.[3] ..... B08B 3/02

[52] U.S. Cl. ..... 134/106; 134/96; 134/107; 137/330

[58] Field of Search ..... 134/105, 106, 107, 108, 134/94, 96; 137/314, 330

[56] References Cited

U.S. PATENT DOCUMENTS

| | | | |
|---|---|---|---|
| 2,962,048 | 11/1960 | Steidley | 134/96 |
| 3,656,492 | 4/1972 | Holm et al. | 134/108 |
| 4,029,517 | 6/1977 | Rand | 134/105 |
| 4,101,340 | 7/1978 | Rand | 134/105 |

*Primary Examiner*—Robert L. Bleutge

*Attorney, Agent, or Firm*—Fleit, Jacobson, Cohn & Price

[57] ABSTRACT

A degreasing apparatus comprises a vessel (3) the lower portion of which is shut off by means of a bowl-shaped plate (5), to form a container (1) with a heating means (2) for boiling solvent. The bowl-shaped plate (5) has an opening (6) at its lowest point. A valve means (7) is arranged at the opening (6). The valve means (7) comprises a body, preferably a ball, which can seal against a seat which surrounds the opening (6). The density and size of the body are related to the size of the opening (6) so that the body floats up from the seat in the presence of solvent condensate, so that condensate can pass from the valve means to the container (1). Vapor pressurized in the container (1) by the heating means (2) lifts the body from the seat so that vapor can flow up into the treatment space of the vessel (3). When the apparatus is shut off, the body seals the opening (6) and thereby prevents evaporation of solvent from the container (1).

2 Claims, 3 Drawing Figures

CLEANING OF OBJECTS WITH SOLVENT

TECHNICAL FIELD

The invention relates to an apparatus for cleaning objects with solvent, comprising a container for liquid solvent, a heat source arranged at the container for evaporation of solvent, and a vessel which is arranged to receive an object to be cleaned, said vessel communicating via an opening in its preferably bowl-shaped bottomportion with the container to be fed with solvent vapour from the container and said vessel being disposed on a higher level than the container to make possible the return of solvent condensate by gravity from the vessel to the container.

BACKGROUND

Conventional apparati for cleaning objects with solvent, for example for degreasing of metal objects, normally contain an upwardly open vessel in which a layer of solvent vapour is maintained. Objects to be cleaned are immersed in the vapour, and the vapour condenses on the object and runs down into the lower portion of the vessel. The bottom region of the vessel is often made as a boiling container for the solvent, with thermostats and cooling means being arranged to assure a suitable vapour level in the vessel.

To reduce loss of vapour out into the atmosphere surrounding the vessel, suction gaps can be arranged at the edge of the vessel to remove solvent-contaminated air for purification.

Apparati of said type can be said to have three operating states, namely a first operating state where the solvent vapour is kept at the intended level in the vessel so that the apparatus is ready for treatment of an object, a second operating state where the solvent is kept warm but with the solvent vapour at a low level so that the apparatus can be made operative relatively quickly, and a third state where the apparatus is shut off, for example on weekends, at night or during lunch.

The last-mentioned state results in losses of solvent due to evaporation. Such loss is undesirable both for economic and environmental reasons, since solvent is relatively costly and national regulations can limit permissible discharge from the apparatus.

OBJECT

An object of the invention is to provide an aparatus of the above-mentioned type, which automatically reduces loss of solvent due to evaporation from the apparatus during said third operating state, without affecting the functioning of the apparatus during said first and second states.

CHARACTERIZATION OF THE INVENTION

The invention is based on an apparatus for cleaning objects by means of solvent, comprising a container for liquid solvent, a heat-source arranged at the container for evaporation of solvent, and a vessel which is arranged to receive an object to be cleaned, said vessel communicating via an opening in the bottom thereof with the container to be fed with solvent vapour from the container, and said vessel being disposed on a higher level than the container to make possible the return of solvent condensate by gravity from the vessel to the container, and is characterized essentially in that a valve means is arranged at the opening, that the valve means comprises a seat which surrrounds the opening and a body which seals against the seat and is arranged in presence of liquid solvent to float up from engagement with the seat and that the valve means is disposed, partly to permit solvent vapour pressurized by the heat source to pass from the container to the vessel, partly to prevent evaporation of solvent from the container to the vessel when the solvent in the container is at a temperature below the boiling point of the solvent.

The opening can be surrounded by a seat in the shape of an annular bowl which is disposed to receive liquid solvent, with the body being arranged to float in the liquid in the bowl so that the body can close off the opening by floating in the liquid in the annular bowl to form a liquid seal or, if the liquid contents of the bowl should be low, by sealing directly against e.g. the inner edge of the annular bowl.

In a preferred embodiment, the valve means can contain a circular seat and a spherical body sealing against the seat, the size and density of the spherical body being adapted to the seat opening so that the body floats up from contact with the seat in the presence of liquid solvent.

The invention will be described below in the form of an example with reference to the accompanying drawing.

DRAWING

EXAMPLE

Figure 1:
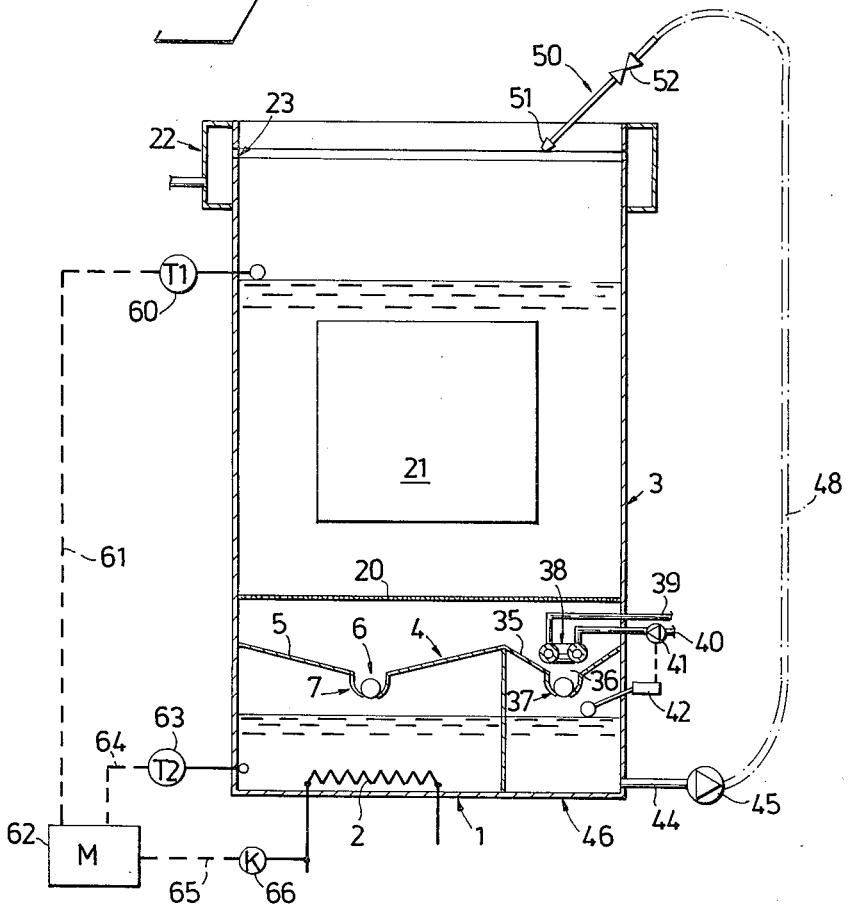
FIG. 1 shows schematically a vertical section through an apparatus according to the invention.

FIG. 1 shows an upwardly open degreasing vessel 3, which has a bottom 4, under which there is a first container 1 and a second container 46. A grill 20 is arranged in the vessel 3 to form a support for objects 21 to be degreased. At the upper edge of the vessel 3, there is a suction box 22 with an intake slot 23 for drawing off solvent-contaminated air. In the container 1, which is designed to contain liquid solvent, there is a heat source 2 for boiling the solvent so that solvent vapour can pass via the valve 7 in the bottom 4 to the vessel 3. A thermostat 60 can be arranged to limit the level of the solvent vapour in the vessel via a wire 61 to an operating means 62, which controls via a wire 65, a power regulator 66 which regulates the effect to the heat source 2. Furthermore, a thermostat 63 can be arranged to regulate, via a wire 64, the operating means 62 to maintain the heat of the solvent in the first container 1 so that the solvent vapour can be quickly transferred to the vessel 3. Above the second container 46, there is a cooling loop 38 through which cold water can be circulated via the lines 39,40. A pump 41 can be arranged in the feed line 40. The pump 41 can be controlled by a level sensor 42. The container 46 has an outlet 44 with a pump 45, which via a hose 48 feeds a spray pistol 50, with a nozzle 51 and an operating valve 52, to provide manual supplementary cleaning of an object 21. The container 46 is covered by a portion of the bottom 4 of the vessel 3. The container 46 cover has a valve means 37 which provides flow of condensate formed on the cooling loop 38 to the container 46.

The container 46 can be made with relatively small dimensions and be placed at a side-wall of the vessel 3 in order to avoid condensate from the object 21 from flowing down into the container 46.

The bottom 4 of the vessel has a first bowl-shaped portion 5 above the first container 1. The lowest point of the bowl-shaped portion 5 has an opening 6 with a valve means 7. Correspondingly, the bottom 4 has a second bowl-shaped portion 35 over the second container 46, an opening 36 being arranged at the lowest point of the portion 35 and a valve means 37 being arranged at the opening 36.

Figure 2:
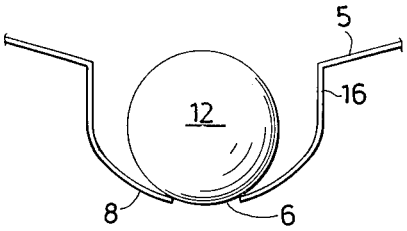
FIG. 2 shows a first embodiment of a valve means in the apparatus according to FIG. 1.
Figure 3:
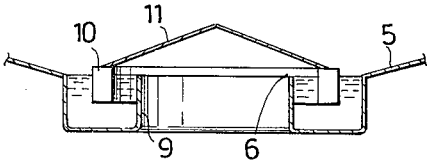
FIG. 3 shows a second embodiment of the valve means.

FIGS. 2 and 3 show different embodiments of the opening 6 and the valve means 7 for the portion 5 above the container 1, but it should be obvious that corresponding arrangements can be made at the second bowl-shaped portion 35 above the second container 46.

FIG. 2 shows a depression 16 at the lowest point of the portion 5. The depression 16 forms a seat 8 which surrounds the opening 6. A ball 12 is placed in the depression 16 to shut off the opening 6 together with the seat 8.

Condensate running from the object 21 is collected on the bottom portion 5 and runs down towards its lowest point, into the depression 16. The ball 12 is made with such a size relative to the opening 6 and with such density that it floats up when there is solvent condensate in the depression 16, so that solvent can flow through the opening 6 down into the container 1.

Vapour generated in the container 1 by means of the heat source, may experience a slight pressure rise, under the influence of the sealing effect of the ball 12 against the seat 8, until the vapour pressure in the container is sufficiently great to lift the ball 12 so that the vapour can flow into the vessel 3. When the heat source 2 is shut off or disposed to only maintain a temperature in the solvent below the boiling point of the solvent, the ball 12 provides a seal for the opening 6 so that evaporation of solvent via the opening 6 to the vessel 3 is prevented.

FIG. 3 shows a valve means comprising an annular bowl 9 around the opening 6. The bowl 9 receives solvent condensate from the vessel 3. An annular floating body 10 is placed in the bowl 9, and carries a disc 11 which is preferably conical. The floating body 10 forms, with the annular bowl 9 filled with liquid, a liquid seal which permits condensate to flow from the vessel 3 to the container 1, and permits vapour to flow from the container 1 to the vessel 3, but prevents evaporation of solvent from the container 1 to the vessel 3. If the condensate in the bowl 9 should evaporate, sealing contact is provided between the inner edge of the bowl 9 (defining the opening 6) and the covering disc 11.

I claim:

1. Apparatus for cleaning objects by means of solvent, comprising a container for liquid solvent, a heat-source arranged at the container for evaporation of solvent, and a vessel which is arranged to receive an object to be cleaned, said vessel communicating via an opening in the bottom thereof with the container to be fed with solvent vapour from the container, and said vessel being disposed on a higher level than the container to make possible the return of solvent condensate by gravity from the vessel to the container, characterized in that a valve means is arranged at the opening, the valve means comprises a seat surrounding the opening, and a body sealing against the seat and disposed to float up from contact with the seat in the presence of liquid solvent, and that the valve means is disposed to permit solvent vapour pressurized by the heat source to pass from the container to the vessel and to prevent evaporation of solvent from the container to the vessel when the solvent in the container is kept at a temperature below the boiling point of the solvent.

2. Apparatus for cleaning objects by means of solvent, comprising a container for liquid solvent, a heat-source arranged at the container for evaporation of solvent, and a vessel which is arranged to receive an object to be cleaned, said vessel communicating via an opening in the bottom thereof with the container to be fed with solvent vapour from the container, said opening surrounded by an annular bowl disposed to receive liquid solvent, and said vessel being disposed on a higher level than the container to make possible the return of solvent condensate by gravity from the vessel to the container, characterized in that a valve means is arranged at the opening, the valve means comprising a seat surrounding the opening, and a body sealing against the seat and disposed to float up from contact with the seat in the presence of liquid solvent and seal directly against the seat in the absence of liquid solvent, and that the valve means is disposed to permit solvent vapour pressurized by the heat source to pass from the container to the vessel and to prevent evaporation of solvent from the container to the vessel when the solvent in the container is kept at a temperature below the boiling point of the solvent.

* * * * *

UNITED STATES PATENT AND TRADEMARK OFFICE

CERTIFICATE OF CORRECTION

PATENT NO. : 4,442,851

DATED : April 17, 1984

INVENTOR(S) : KURT A. HOLM

It is certified that error appears in the above-identified patent and that said Letters Patent is hereby corrected as shown below:

On the title page, line [30], change the priority data date from "May 24, 1981" to --June 24, 1981--.

Signed and Sealed this

*Ninth* Day of *April 1985*

[SEAL]

*Attest:*

DONALD J. QUIGG

*Attesting Officer* *Acting Commissioner of Patents and Trademarks*